United States Patent [19]

Dasher

[11] Patent Number: 4,555,915

[45] Date of Patent: Dec. 3, 1985

[54] DEFLECTABLE AIR BAFFLE ASSEMBLY FOR REFRIGERATOR

[75] Inventor: Marie E. Dasher, Knight Township, Vanderburgh County, Ind.

[73] Assignee: Whirlpool Corporation, Benton Harbor, Mich.

[21] Appl. No.: 677,674

[22] Filed: Nov. 30, 1984

[51] Int. Cl.[4] ..... F25D 19/02

[52] U.S. Cl. ..... 62/448; 62/428; 62/507

[58] Field of Search ..... 62/272, 282, 428, 298, 62/448, 449, 507, 531, 465, 466, 382, 265; 312/258, 236

[56] References Cited

U.S. PATENT DOCUMENTS

| | | | |
|---|---|---|---|
| 2,702,459 | 2/1955 | Thompson | 62/382 X |
| 2,811,840 | 2/1952 | Thompson | 62/382 |
| 2,952,997 | 10/1957 | Mullin | 62/409 |
| 3,079,770 | 3/1963 | Brown et al. | 62/507 X |
| 3,142,162 | 3/1962 | Herndon, Jr. et al. | 62/295 |
| 3,162,023 | 5/1963 | Smith | 62/455 |
| 3,468,105 | 9/1969 | Cline | 62/262 |
| 4,047,393 | 10/1976 | Hanson et al. | 62/428 |
| 4,490,991 | 1/1985 | Griffin | 62/448 X |

*Primary Examiner*—Lloyd L. King

*Attorney, Agent, or Firm*—Wood, Dalton, Phillips, Mason & Rowe

[57] ABSTRACT

According to the invention, a compressible, resilient baffle member is provided and held captive compressibly against a partition wall in a refrigeration apparatus machinery compartment by a resilient retainer clip. The retainer clip straddles the baffle member surface and has legs which terminate in offset free ends which extend into a specially configured aperture in the partition wall. The baffle member biases the offset ends of the clip legs into contact with the surface of the wall opposite to the baffle mounting surface. When the baffle is rotatably displaced the one clip leg slides into the aperture and the opposite leg rotates about an edge of the aperture. The resilience of the baffle member and clip restore the baffle to the original position.

15 Claims, 6 Drawing Figures

FIG. 1
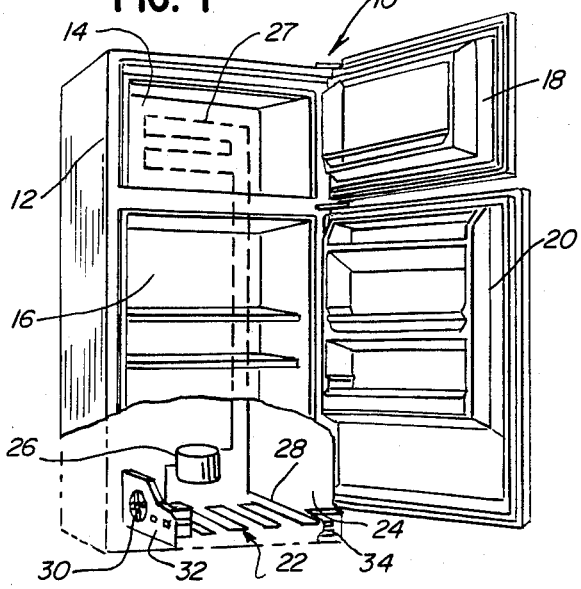
FIG. 3
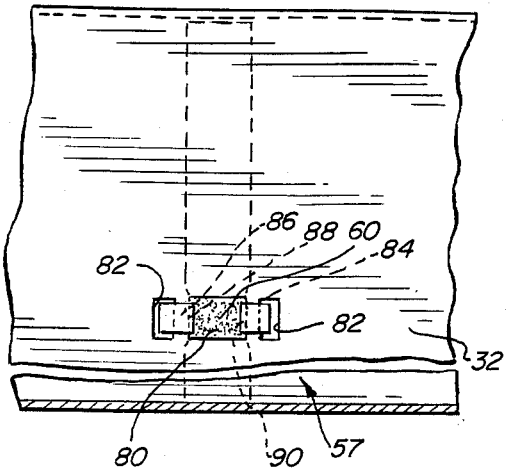
FIG. 4
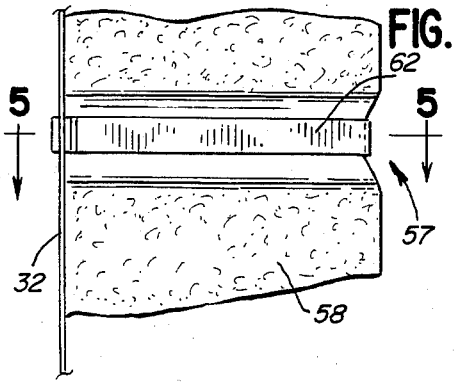
FIG. 6
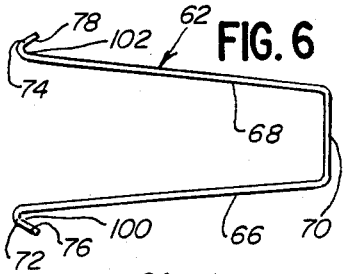
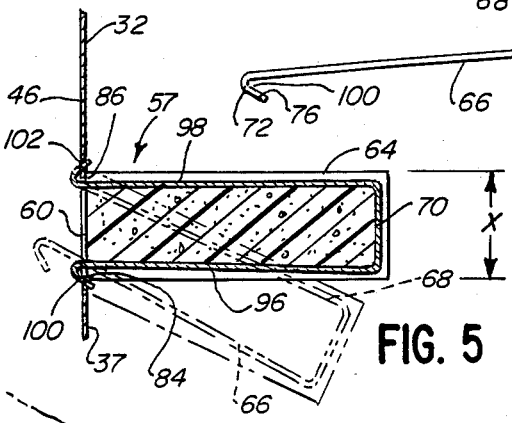
FIG. 5
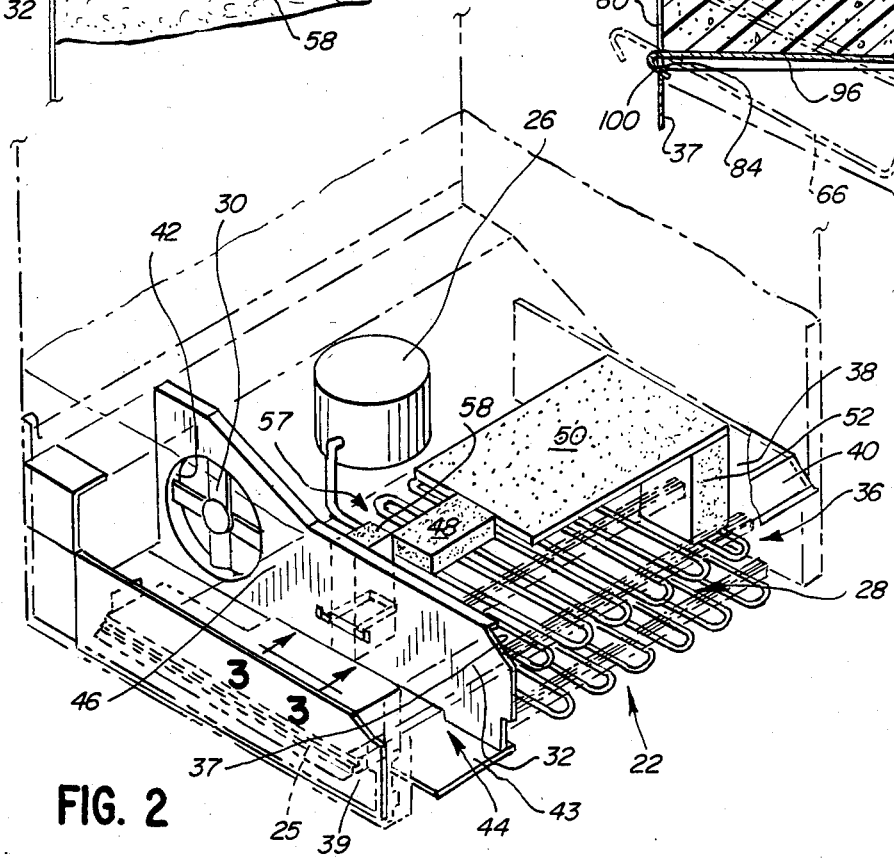
FIG. 2

DEFLECTABLE AIR BAFFLE ASSEMBLY FOR REFRIGERATOR

BACKGROUND OF THE INVENTION

1. Field of the Invention

This invention relates to refrigeration apparatus and, more particularly, to means for retaining an air baffle on a partition wall within the refrigeration apparatus.

2. Description of the Prior Art

One known construction for a refrigeration apparatus employs a sealed, self-contained refrigeration unit having a condenser, compressor and evaporator. The refrigeration unit is slidably installed in the cabinet as a unit from the rear of the refrigeration apparatus, with the high-side components, the condenser and the compressor, placed in a machinery chamber, bounded by the cabinet walls beneath a deck member.

Such apparatus typically includes a fan for inducing a forced air flow through the machinery compartment to remove heat from the condenser and compressor, the air flow having a circulation path defined about a partition which separates the path of air ingress and egress. To assure a proper air flow over the condenser, the partition is extended into contact with the condenser. This is conventionally accomplished by providing a baffle made of compressible, resilient material between the partition and the condenser. The baffle, in addition to directing the air flow, suppresses sound within the unit.

Several problems have been encountered in adhesively mounting such baffles in the conventional manner to the partition wall. Because the baffle is preassembled to the partition before the insertion of the refrigeration unit, and the baffle is to be in abutment with the condenser, the baffle may be subjected to mechanical shock during assembly of the refrigeration unit. The baffle may be dislodged or come loose in one or more pieces and foul the air circulation fan as the suction force tends to draw the baffle pieces into it.

Another serious problem is found in the adhesive used to secure the baffle to the partition. The adhesive bonding strength tends to diminish with time as the adhesive degrades when exposed continuously to the heat developed in the machinery compartment.

SUMMARY OF THE INVENTION

The present invention is directed to overcoming the above enumerated problems in a novel and simple manner.

According to the invention, a compressible, resilient baffle member is held captive compressibly, by a resilient retainer clip, against a partition wall of the refrigeration apparatus. The clip is generally channel-shaped, having slightly diverging leg portions terminating adjacent free ends thereof. The free ends are offset out of the line of the legs and in the illustrated embodiment are returned. In assembly, the retainer clip straddles the baffle member which bears against a wall surface having a specially configured aperture therein. The legs on the clip are urged towards each other and extended into the aperture on the mounting wall which has a surface facing oppositely to the surface against which the baffle member bears. The offset portions of the clip seat behind the wall surface with the legs biased toward their undeflected configuration.

The baffle assembly provides a sturdy mount for the baffle member which is not susceptible to degradation with age or heat. The nature of the baffle assembly makes it capable of withstanding shock encountered during assembly of the refrigeration unit. Further, the compressible and resilient nature of the baffle material is not compromised by providing the retainer clip, and may even be enhanced thereby. Further, the baffle assembly may be readily installed with automated equipment and is simple and inexpensive to construct and assemble.

Other objects and advantages of the invention will become apparent upon reviewing the following detailed description taken in conjunction with the drawings and the appended claims.

BRIEF DESCRIPTION OF THE DRAWINGS

FIG. 1 is a front, perspective view of an open refrigeration apparatus broken away to show the machinery compartment wherein a baffle assembly of the present invention is provided;

FIG. 2 is a perspective view of the machinery compartment of the refrigeration apparatus of FIG. 1 incorporating a preferred form of the baffle assembly according to the present invention;

FIG. 3 is a fragmentary, rear elevation view of one surface of a wall to which the baffle assembly is mounted, taken along line 3—3 of FIG. 2;

FIG. 4 is a fragmentary, side elevation view of the mounted baffle assembly;

FIG. 5 is a sectional view of the baffle assembly along line 5—5 of FIG. 4 and showing a deflected position for the baffle assembly in phantom; and FIG. 6 is a plan view of a spring retainer clip used on the baffle assembly.

DESCRIPTION OF THE PREFERRED EMBODIMENT

In FIG. 1, an upright refrigeration apparatus is disclosed at 10 and is illustrative of a structure with which the present invention is operable. The refrigeration apparatus 10 comprises a cabinet 12 defining an upper freezing compartment 14 and a fresh food compartment 16, therebelow. In addition, a nonrefrigerated machinery compartment 24 is located beneath the fresh food compartment. Hinged access doors 18, 20, respectively, selectively seal the freezing and fresh food compartments. A louvered grille 34 covers the machinery compartment. The compartments 14 and 16 are cooled by a conventional sealed refrigeration system which comprises a compressor 26, a condenser 28 and an evaporator 27.

The high-side portion 22 of the sealed refrigeration system, which is detailed in FIG. 2 at 22, is located in the cabinet 12 in machinery compartment 24 and comprises compressor 26 and condenser 28. The refrigeration system is conventional in construction and prefabricated as a unit with the high-side portion 22 arranged for sliding installation on cooperating guide rails 25 (only one shown) from the rear of the refrigeration apparatus 10.

Movement of cooling air over condenser 28 and compressor 26 is effected by a circulating fan 30 rotated by a motor (not shown). A U-shaped path of cooling air is defined about a vertical, forwardly extending, thin-walled central or center partition 32 which has an opening 42 formed therein for mounting fan 30. Room air is drawn by fan 30 through grille 34 at the front of the machinery compartment 24. The fan draws the air initially over condenser 28, which resides in a chamber 36 defined cooperatively by a deck support 38, one surface 37 of the central partition 32 and a deck member 40. The incoming air in chamber 36 is next circulated by fan 30 across compressor 26 and then through opening 42 in partition 32 and exhausted through a duct 44 bounded by the opposite surface 46 of central partition 32, deck member 40, a deck support 39 and a bottom plate 43. Because the air flow is forced in and out through the front grille 34, provision need not be made for rear air circulation which makes possible positioning of the refrigerator flush with a room wall.

To muffle the sound of high-side portion 22, sound deadening insulation is provided in machinery compartment 24. In chamber 36, two insulation blocks 48, 50 are secured at the underside of deck member 40. An additional insulation block 52 is secured to deck support 38 below insulation block 50. Two additional insulation pieces (not shown) are arranged within duct 44.

To assure that substantially all of the air flow entering chamber 36 will flow through condenser 28 the gap between center partition 32 and the condenser must be closed. To accomplish this end, a baffle assembly 57 is attached to partition 32 and spans to the condenser. Baffle assembly 57 includes a resilient, compressible, rectilinear baffle member 58, a resilient retainer clip 62, and a specially configured mounting opening provided in partition 32, to be described in detail below. The baffle assembly function is twofold; it absorbs sound to quiet the entire system and diverts substantially all of the incoming air in chamber 36 through the condenser.

The baffle member 58 is, in the preferred embodiment, a fiberglass mat material but may alternatively be a resilient plastic foam such as polyether urethane foam. Its resilience allows for manufacturing tolerances and prevents damage to the baffle member or the condenser during insertion of the high-side portion 22 of the refrigeration system into machinery compartment 24, as elaborated below. Details of the baffle assembly are illustrated in FIGS. 3–6.

The baffle member 58 has a flat surface 60 which bears against surface 37 of center partition 32. To positively retain baffle member 58 against partition 32, a resilient retainer clip 62 is provided. The retainer clip 62 is channel-shaped, conforming substantially to the peripheral surface 64 of the baffle member, and has spaced legs 66, 68 joined by a web 70. The legs 66, 68 diverge slightly distal from web 70 and have free, offset ends or distal portions 72, 74. In the preferred embodiment ends 72, 74 each have a returned portion 76, 78 respectively. Retainer clip 62 is made of tempered spring steel and is resilient.

As shown in FIG. 3, to resiliently retain baffle assembly 57 in position against surface 37 a specially configured opening is provided in center partition 32. This opening comprises a central, rectangular, admitting aperture 80 and, locking apertures 82 horizontally spaced on each side of the admitting aperture 80. The spacing between apertures 80 and 82 defines ribs 84, 86, which coact with clip 62.

To assemble baffle member 58 to partition 32, clip 62 is first positioned in straddling relationship over peripheral surface 64 of the baffle member. Legs 66, 68 are then compressed towards each other sufficiently to allow ends 72, 74 to clear facing edge portions 88, 90, defined by admitting aperture 80. As free ends 72 and 74 of the clip are extended into admitting aperture 80, the baffle member is compressed by the clip against wall surface 37 of center partition 32.

Upon returned portions 76, 78 clearing facing edge portions 88, 90, legs 66, 68 are released and will self-bias outwardly so that outer surfaces 96 and 98 of the clip bear against facing edge portions 88, 90. At the same time, the resilient forces in the compressed baffle member 58 bias the clip away from surface 37 so that ribs 84, 86 nestle in curved seats 100, 102 defined as the inner surface of returned portions 76 and 78 of legs 66, 68.

The web 70 of retainer clip 62 is slightly smaller in dimension than thickness X of the baffle member. As a result, straddled peripheral surface 64 of the baffle member is compressed by the clip so that the clip securely grasps the baffle member. The clip will tend to pull the baffle member into contact with surface 37 because of the restraint ribs 84 and 86 place on the respective curved seats 100 and 102 of the clip. A counterbalancing force is placed on the clip by the resiliency of the baffle member which tends to draw the clip against ribs 84, 86. As a result of these counterbalancing forces the baffle assembly tends to be self-aligning and self-restoring after displacement.

FIG. 5 demonstrates what happens to the baffle assembly when it is impacted, as upon inserting the refrigeration system. Under a force applied laterally to the baffle assembly (from above as viewed in FIG. 5) one leg 66 of clip 62 is caused to slide along edge portion 90 and extend further through aperture 80, while rib 86 serves as a pivot for the clip to rotate around seat 102. As can be seen in FIG. 5, this movement compresses the mid-section of baffle member 58. In addition, this movement causes outer surface 96 of leg 66 to be deflected by edge portion 90 which further compresses legs 66 and 68 of the clip toward each other. The forces created by compression of both the baffle member and clip legs tend to return the baffle assembly to its initial and preferred orientation. It is thus seen that the resilient retainer clip 62 adds to the resilience of the baffle member 58 to provide a baffle assembly that is more resilient and more durable than the prior art devices.

If an impact force is alternatively applied to the outer edge of the baffle assembly (from the right as viewed in FIG. 5), then legs 66 and 68 of the clip will both slide along their respective edge portions further into aperture 80. This motion compresses baffle member 58 creating a force to return the baffle assembly to its original orientation.

To provide resiliency to the clip, a spring steel is employed in fabrication and should be of a preselected thickness to resist permanent deformation under an anticipated impact force but to deflect sufficiently as previously described under that force. In the preferred embodiment 0.023 inch by 0.25 inch #3 tempered steel is used.

While it is preferred to provide three separate apertures 80, 82 with mounting ribs 84, 86, defined therebetween the invention also contemplates a mounting opening comprising but a single aperture with facing edge portions. Further, as long as the end portions of the clip legs are offset oppositely out of the line of their respective legs, the offset portions will seat behind a surface of the partition wall to prevent the separation of the baffle assembly from surface 37. Therefore, the invention contemplates a clip in which the legs terminate in free ends that are offset but not returned.

It should be understood that the foregoing detailed description was made for purposes of demonstrating the structure and operation of the invention, with no unnecessary limitations to be understood therefrom.

I claim:

1. In a refrigeration apparatus having a thin wall, a baffle assembly resiliently mounted to said wall comprising:

edge means defining an opening in said wall, a resiliently compressible baffle member defining a peripheral surface, a first portion of said peripheral surface contacting said wall adjacent said opening, and a spring retainer means having a portion extending into said opening and engaging said wall for retaining said baffle member in contact with said wall, said baffle member having a portion captively maintained between a portion of the retainer means and wall;

said retainer means acting in cooperation with the resilience of said baffle to keep said retainer means engaged with said wall and to keep said baffle member resiliently mounted to said wall.

2. In a refrigeration apparatus having a thin wall with opposite first and second sides, a baffle assembly resiliently mounted to said wall comprising:

edge means defining an opening in said wall at least partially bounded by spaced, facing edge portions;

a resiliently compressible baffle member defining a peripheral surface, a first portion of said peripheral surface engaging said first side of said wall; and a spring retainer clip defining a pair of legs interconnected at one end thereof and terminating in offset distal portions at an opposite end thereof, said spring retainer clip embracing a second portion of the peripheral surface of the baffle member, said legs extending through said wall opening from said first side of said wall, said legs biased away from each other to engage said facing edge portions, said offset distal portions disposed on said second side of said wall to lock the baffle assembly to said wall.

3. The refrigeration apparatus according to claim 2 wherein said baffle member has a rectilinear configuration and said first portion of said peripheral surface is substantially flat for flushly abutting said first side of said wall and said spring retainer clip is substantially channel-shaped.

4. The refrigeration apparatus according to claim 2 wherein said legs are spaced so that the baffle member is compressed between said legs.

5. The refrigeration apparatus according to claim 3 wherein said retainer clip comprises a web and substantially straight legs attached thereto, and further wherein said legs diverge away from said web.

6. The refrigeration apparatus according to claim 2 wherein a rib is defined adjacent each said facing edge portion and said offset distal portion on each said leg is returned to define a seat with its respective leg, each said rib nestled within one said seat.

7. The refrigeration apparatus according to claim 2 wherein said baffle member is made from a polyether urethane foam.

8. The refrigeration apparatus according to claim 2 wherein said baffle member is made from a fiberglass mat.

9. The refrigeration apparatus according to claim 2 wherein said spring retainer clip is made from tempered spring steel.

10. The refrigeration apparatus of claim 5 wherein said baffle member is closely captured between said web of said clip and said first side of said wall and resists movement of said clip legs into the opening to bias said offset distal portions into contact with said second side of said wall.

11. In a refrigeration apparatus having a cabinet defining a compartment, said compartment including a thin wall member having opposite first and second generally planar surfaces, a deflectable baffle assembly mounted to said wall member, said baffle assembly comprising:

a compressible resilient baffle member having a generally rectilinear cross section and extending perpendicularly from said first planar surface of said wall member;

a resilient channel-shaped spring retainer clip having a web and a pair of spaced, slightly diverging legs attached to the ends of said web, each of said legs terminating in an offset end extending generally in a direction opposite the other said leg;

edge means defining an opening in said wall member having a pair of facing edge portions spaced a distance preselected to cause said diverging legs to deform toward each other with said spring retainer clip inserted between said edge portions;

said resilient baffle overlying said edge means and said spring retainer clip straddling said resilient baffle member with said legs contacting said facing edge portions and said offset ends proximate said second surface.

12. The refrigeration apparatus according to claim 11 wherein the dimension of said baffle member extending perpendicularly from said first planar surface is greater than the distance between said web and said first planar surface whereby the baffle member is compressed against said first planar surface and residual forces in the baffle member tend to urge said offset ends against said wall member second planar surface.

13. The refrigeration apparatus according to claim 11 wherein said offset ends each define a returned portion which, in conjunction with its respective leg, defines a seat and wherein a locking aperture is formed closely adjacent each said facing edge defining a rib therebetween, each said rib nestled within a seat to allow the respective leg to pivot thereabout.

14. The refrigeration apparatus according to claim 11 wherein said baffle member has a substantially uniform thickness perpendicular to said first planar surface and said baffle member thickness is greater than the spacing between said legs of said spring retainer clip at said web.

15. In a refrigeration apparatus having a cabinet defining a machinery compartment, heat dissipating components disposed in said machinery compartment, a plurality of surfaces including at least one thin wall member defining opposing first and second generally planar surfaces for directing air entering said machinery compartment into contact with said heat dissipating components, and air moving means within said compartment, an air baffle assembly mounted to said thin wall member, said air baffle comprising:

a compressible resilient baffle member having a generally rectangular cross section of preselected thickness and height;

means defining a rectangular opening in said thin wall member having a first pair of opposing edge portions and a second pair of opposing edge portions generally perpendicular to said first edge portions, a pair of parallel ribs transversing said opening between said first pair of opposing edge portions, said parallel ribs separated substantially said preselected thickness of said baffle member and spaced inwardly from said second pair of opposing edge portions;

a channel-shaped retainer clip having a flat base and a pair of spaced, slightly diverging legs attached to said base, each said leg terminating in a returned free end extending outwardly with respect to the other said leg, said legs spaced substantially the distance of said preselected thickness of said baffle member and having a length substantially equal to said preselected height of said baffle member;

said baffle member extending perpendicularly from said first planar surface between and parallel with said ribs, said retainer clip straddling said baffle and inserted in said opening between said ribs with each said returned free end engaging one of said ribs on said second planar surface.

* * * * *